US010527372B2

(12) United States Patent
Brown

(10) Patent No.: US 10,527,372 B2
(45) Date of Patent: Jan. 7, 2020

(54) FIREARM WITH SIDE CHARGING HANDLE

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 0 days.

(21) Appl. No.: 16/503,709

(22) Filed: Jul. 5, 2019

(65) Prior Publication Data

US 2019/0331443 A1 Oct. 31, 2019

Related U.S. Application Data

(62) Division of application No. 16/229,731, filed on Dec. 21, 2018, now Pat. No. 10,443,964.

(60) Provisional application No. 62/632,447, filed on Feb. 20, 2018.

(51) Int. Cl.

| | |
|---|---|
| ***F41A 3/72*** | (2006.01) |
| ***F41A 3/84*** | (2006.01) |
| ***F41A 3/12*** | (2006.01) |
| ***F41A 3/82*** | (2006.01) |

(52) U.S. Cl.

CPC ..... *F41A 3/72* (2013.01); *F41A 3/12* (2013.01); *F41A 3/82* (2013.01); *F41A 3/84* (2013.01)

(58) Field of Classification Search

CPC ..... F41A 7/02; F41A 3/72
USPC ..... 89/1.4
See application file for complete search history.

(56) References Cited

U.S. PATENT DOCUMENTS

| | | | | |
|---|---|---|---|---|
| 2,322,780 | A * | 6/1943 | Gorton | F41A 3/72 42/20 |
| 4,565,113 | A * | 1/1986 | Bunning | F41A 17/00 89/1.4 |
| 8,333,137 | B2 * | 12/2012 | Sirochman | F41A 3/72 89/1.4 |
| 8,342,075 | B2 * | 1/2013 | Gomez | F41A 5/18 89/191.01 |
| 2018/0202732 | A1 * | 7/2018 | Gibbens | F41A 3/72 |

* cited by examiner

*Primary Examiner* — Reginald S Tillman, Jr.
(74) *Attorney, Agent, or Firm* — Wood Herron & Evans LLP

(57) ABSTRACT

Provided is a side charging handle system for an AR-pattern firearm with an upper receiver having an internal longitudinal bore for receiving a bolt carrier assembly for longitudinal reciprocation therein, a side longitudinal guide slot, and a side charging handle having an engagement pin extending through guide slot to engage the bolt carrier assembly.

3 Claims, 9 Drawing Sheets

FIREARM WITH SIDE CHARGING HANDLE

CROSS-REFERENCE TO RELATED APPLICATIONS

This application is a divisional application of pending U.S. patent application Ser. No. 16/229,731, filed Dec. 21, 2018, which claims the benefit of priority to U.S. Provisional Patent Application Ser. No. 62/632,447, filed on Feb. 20, 2018, the disclosures of which are incorporated by reference herein.

TECHNICAL FIELD

This invention relates to an AR-pattern firearm having a reduced length bolt carrier and recoil spring assembly that can be contained within an upper receiver without the need for a rearward receiver extension tube. This invention also relates to the provision of a side-located, non-reciprocating charging handle for an AR-pattern firearm.

BACKGROUND

A well-known and typical feature of the common AR-pattern firearm is a receiver extension tube that houses a recoil buffer and spring, providing an axially aligned enclosure for reward movement of a standard bolt carrier assembly. Although acting as an extension of the upper receiver, it is mounted to the lower receiver and requires that the recoil buffer and spring be separable from the bolt carrier assembly. When configured as a rifle, this extension is accommodated within and supports a buttstock. However, this structure makes it challenging to use a folding buttstock and, if damaged, may render the firearm inoperable. Additionally, this extension can be an awkward protrusion when configured as a handgun. Some designs have shortened, but not eliminated, the extension tube.

The standard T-shaped rear charging handle is not ergonomically ideal in location and, in direct impingement systems, can allow hot gas to escape the upper receiver near the user's face. Other side charging handle designs for the AR-pattern firearm have required extensive modification and used many nonstandard parts.

SUMMARY OF THE INVENTION

The present invention provides a nonreciprocating charging handle situated on the side of the upper receiver that may be guided on an external track. It also provides a shortened bolt carrier and recoil spring assembly that can be housed and reciprocate entirely within the upper receiver.

The side charging handle system includes an upper receiver configured to attach to a standard AR-pattern lower receiver and having an internal longitudinal bore for receiving a bolt carrier assembly for longitudinal reciprocation therein and a side longitudinal guide slot. A side charging handle having an engagement pin extending through guide slot to engage the bolt carrier assembly. The bolt carrier assembly includes a bolt carrier body with an engagement pin socket configured to cause rearward movement of the bolt carrier assembly when the charging handle is retracted to the rear in the side longitudinal guide slot while allowing the bolt carrier assembly to retract independently of the side charging handle.

The compact bolt carrier system includes an upper receiver having an internal longitudinal bore for receiving a bolt carrier assembly for longitudinal reciprocation therein and a longitudinal recoil spring guide channel positioned above the internal longitudinal bore. A bolt carrier assembly has a bolt carrier body configured in length to reciprocate substantially entirely within the upper receiver and has a top lug extending into the recoil spring guide channel. A recoil spring is in the recoil spring guide channel.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
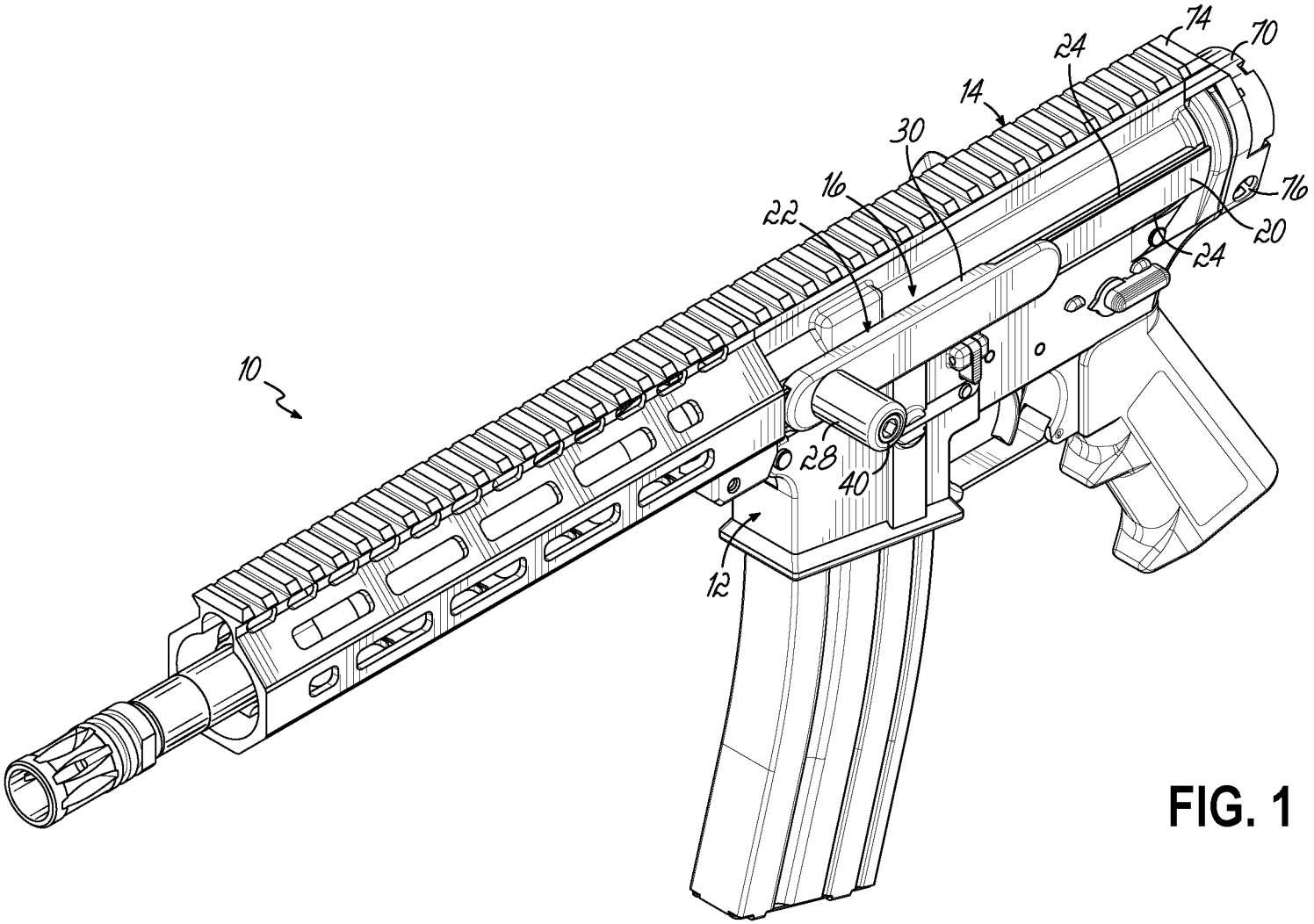
FIG. 1 is an isometric view of an AR-pattern firearm, configured as a pistol, according to certain embodiments of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIG. 1, therein is shown an AR-pattern firearm 10 according to certain embodiments of the present invention. As used herein, "AR-pattern" firearm is understood to include the AR15, AR10, M16, M4, and variants thereof. The illustrated embodiment is in the form of a handgun, although the present invention may be used in a rifle configuration, as well. Embodiments of the invention may be used with an ordinary and standard (MIL-STD specification) AR-pattern lower receiver 12 and fire control group. The upper receiver 14 may be specially adapted to accommodate a side charging handle 16. In the illustrated embodiment, the charging handle 16 is situated on the left-hand side of the upper receiver 14 and configured to eject spent casings to the right in the ordinary manner of an AR-pattern firearm.

Referring now also to FIGS. 2-6, the upper receiver 14 includes an elongated access slot 18 and an elongated guide rail 20 substantially parallel thereto. A charging handle body 22 is configured to slide longitudinally along the guide rail 20. In the illustrated embodiment, the guide rail 20 includes upper and lower channels 24 which may be engaged by complementary configured key rails 26 on the charging handle body 22. The location of the rails and grooves may be reversed and/or a sliding dovetail engagement may be used.

Figure 2:
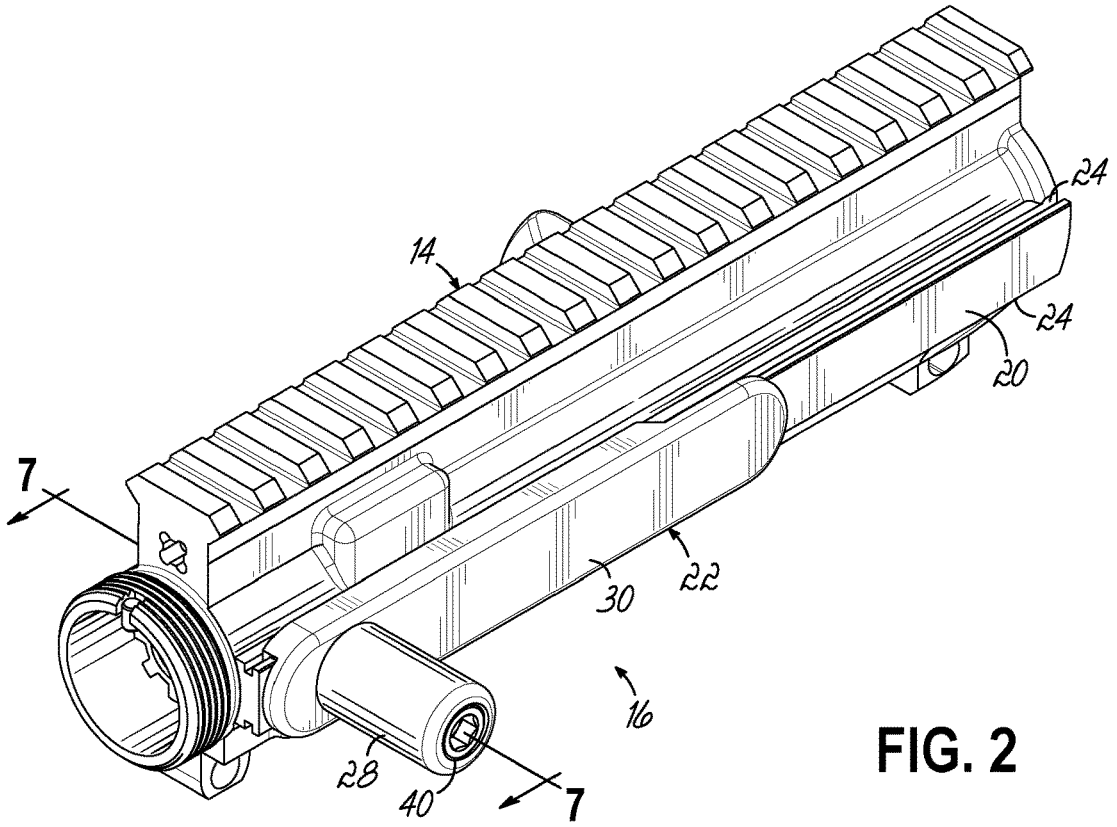
FIG. 2 is an isometric view of an upper receiver, bolt carrier assembly, and side charging handle according to embodiments of the present invention.
Figure 3:
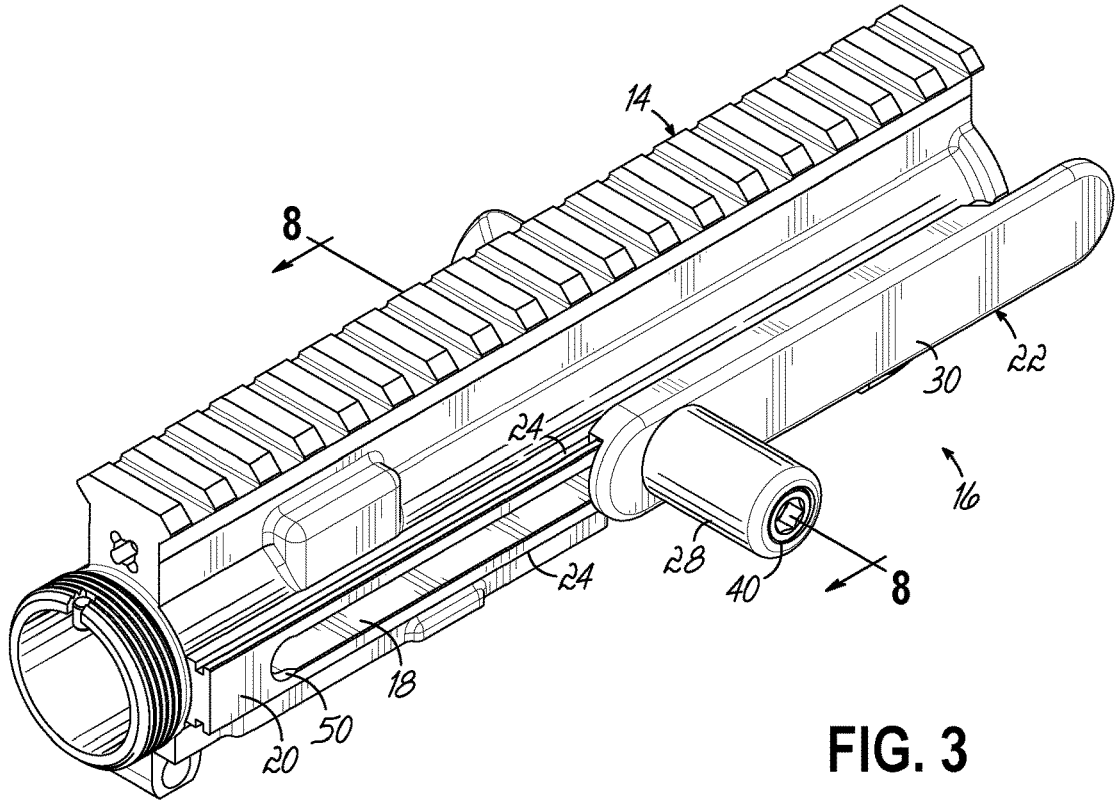
FIG. 3 is a similar view showing the charging handle and bolt carrier assembly in a retracted position.

The charging handle body 22 includes a handle portion 28 that extends outwardly to be grasped by the user's hand and an elongated cover portion 30 that will cover the slot 18 in the upper receiver 14 when the side charging handle 16 is in the forward position (FIGS. 1 and 2). The handle portion 28 and cover portion 30 may be formed from a unitary piece of material or may be formed separately and rigidly attached together. Leverage of the manual force applied to the handle portion 28 is distributed over the length of the cover portion 30 such that the channel and key rail engagement 24, 26 slides smoothly and avoids binding.

The side charging handle 16 also includes a plunger 32 that extends into the interior of the upper receiver 14 through the slot 18 to engage a bolt carrier assembly 34, 34*a*. The plunger may also be integral with the handle 16 and cover 30, or as illustrated, may be separate. In the illustrated embodiment, the plunger 32 may be inserted into a bore 36 in the handle portion 28 along with a plunger spring 38 and be retained in place with a cap or fastener, such as a set screw 40. The plunger 32 may include an annular shoulder 42 which causes the plunger 32 to be captured by a smaller sized opening 44 in the charging handle body 22. The inwardly extending end 46 of the plunger 32 may engage a notch 48 provided in the bolt carrier assembly 34, 34*a*. The forwardly open configuration of the notch 48 allows the bolt carrier assembly 34, 34*a* to reciprocate without moving the side charging handle 16. However, pulling the side charging handle 16 toward the rear (FIGS. 3 and 9) necessarily retracts the bolt carrier assembly 34, 34*a* along with it. Forward return of the bolt carrier assembly 34, 34*a* manually or under spring force returns the charging handle 16 to the forward position (FIGS. 1 and 2). If desired, an engagement recess (not shown) can be configured to fixedly engage the plunger 32 (rather than the forwardly open notch 48) to cause the side charging handle 16 to reciprocate with the bolt carrier 34, 34*a*.

Figure 4:
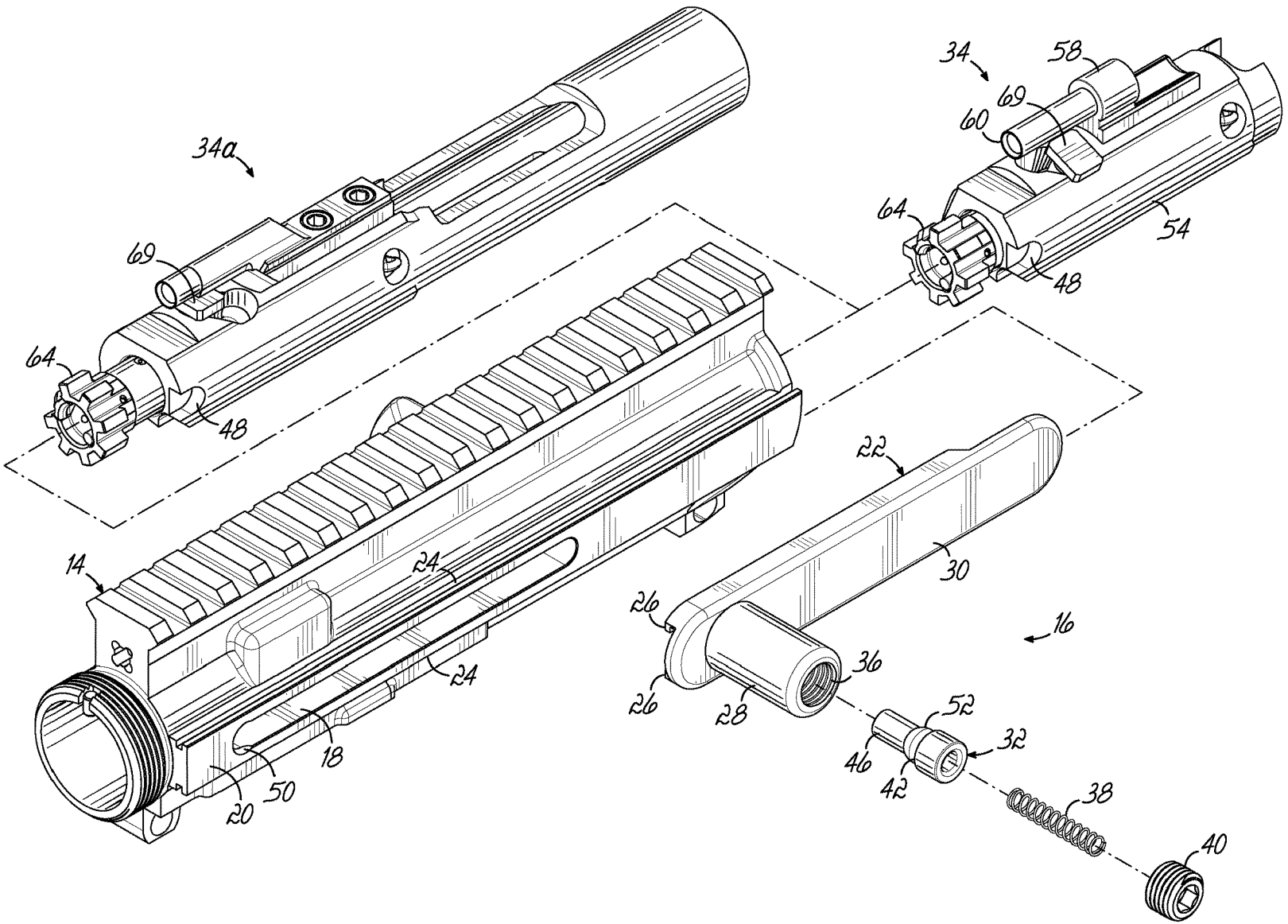
FIG. 4 is an exploded isometric view thereof showing both a standard AR-pattern bolt carrier assembly and one according to an embodiment of the present invention.
Figure 5:
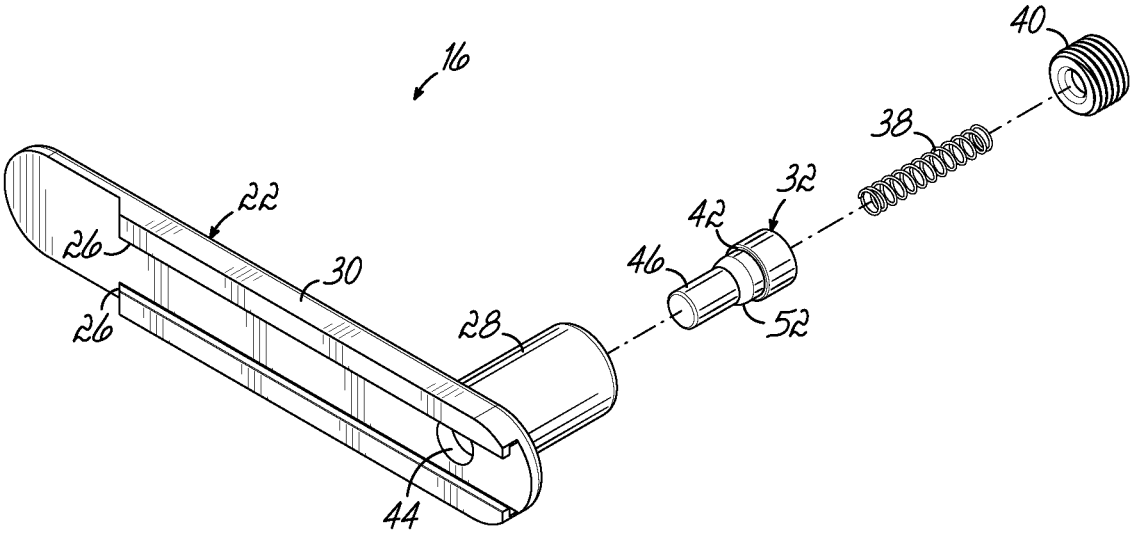
FIG. 5 is a first isometric exploded view of a charging handle assembly according to an embodiment of the present invention.
Figure 6:
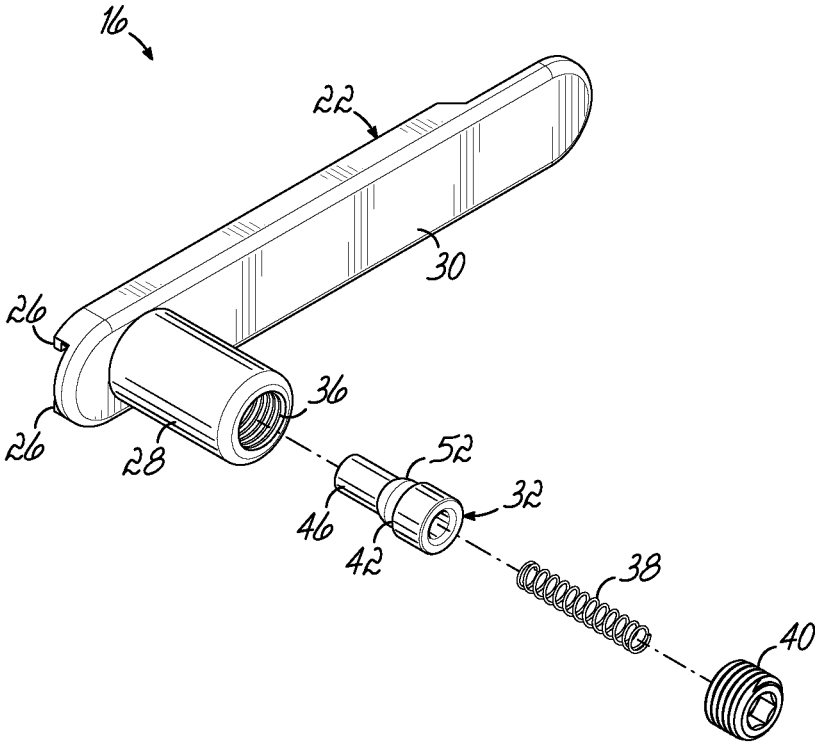
FIG. 6 is a reverse isometric exploded view thereof.
Figure 7:
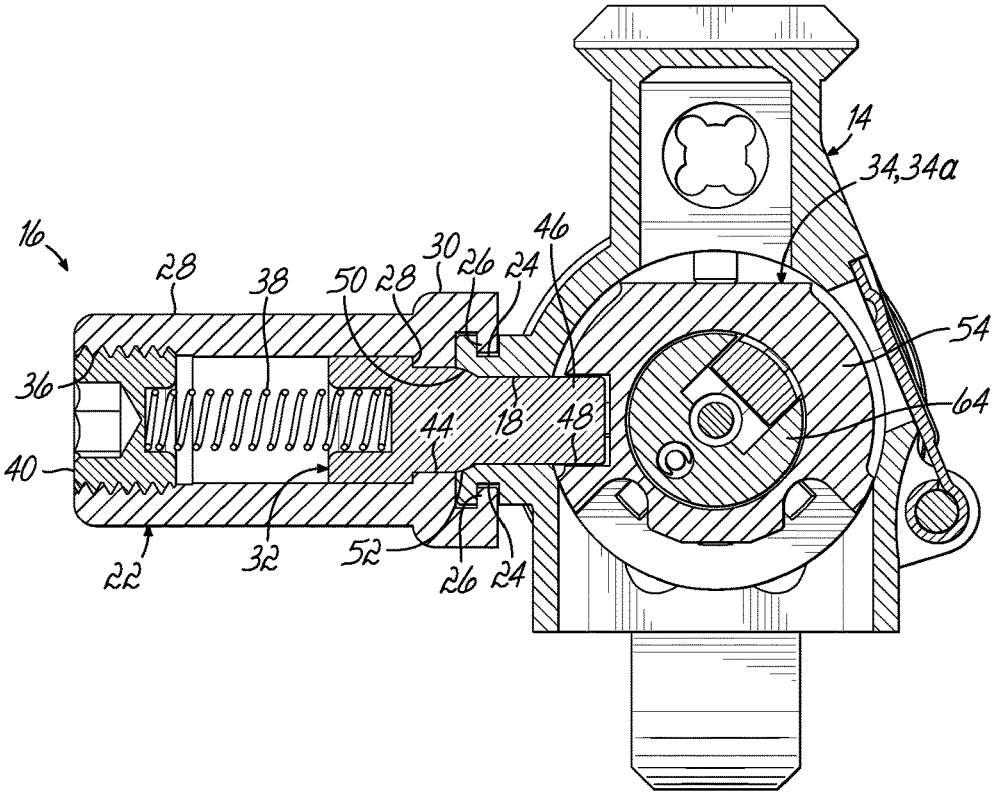
FIG. 7 is a cross-sectional view taken generally along line 7-7 of FIG. 2.
Figure 8:
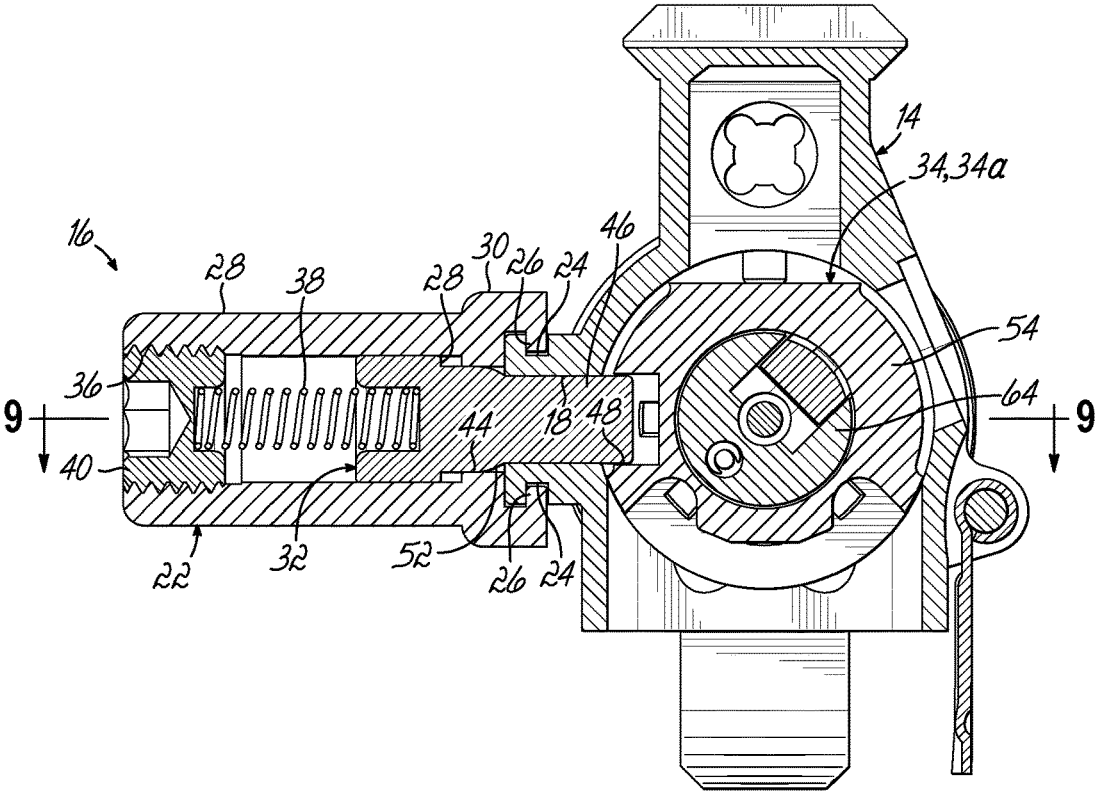
FIG. 8 is a cross-sectional view taken generally along line 8-8 of FIG. 3.
Figure 9:
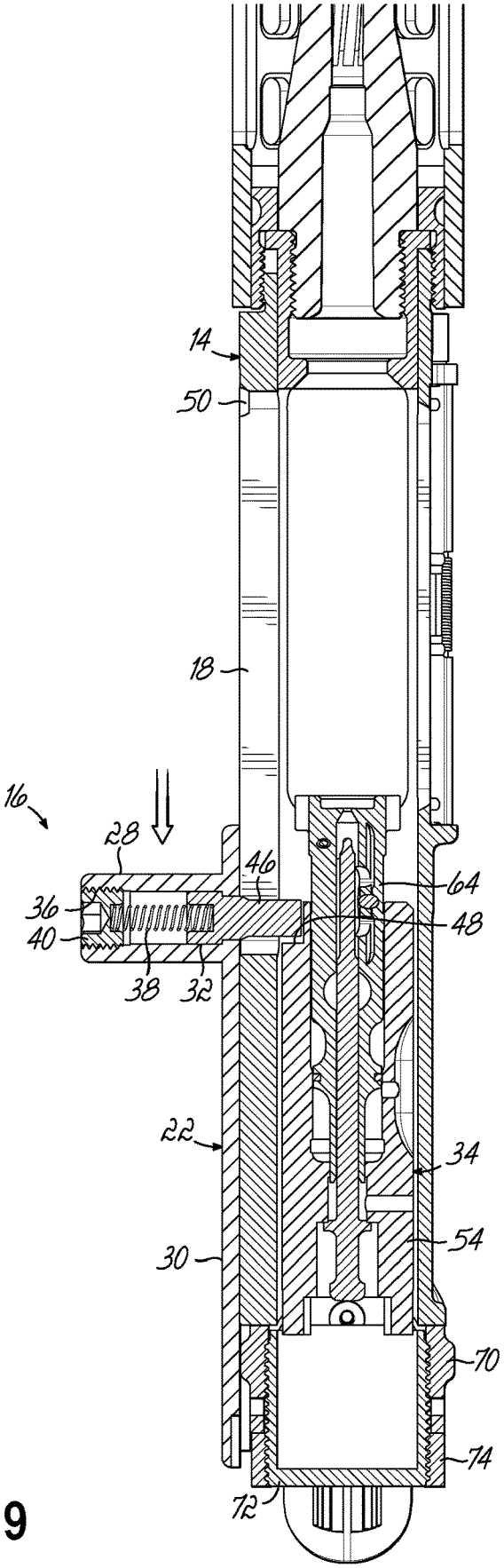
FIG. 9 is a top longitudinal sectional view taken generally along line 9-9 of FIG. 8, including a portion of the barrel and handguard.

Referring now in particular to FIGS. 4, 7, and 8, the forward end of the slot 18 in the upper receiver 14 may include a beveled or concave countersink 50. The plunger 32 may include a complementary beveled or rounded engagement shoulder 52 which is biased by the plunger spring 38 into engagement with the countersink 50 to provide a retention detent when the side charging handle 16 is in the forwardmost position (FIGS. 2 and 7). As shown in FIGS. 8 and 9, when the side charging handle 16 is manually pulled toward the rear, the engagement shoulder 52 of the plunger 32 is displaced from its seat in the countersink 50 against the spring force of the plunger spring 38. The plunger 32 then rides in this displaced position as the side charging handle 16 is cycled and returns into this detent engagement when the side charging handle 16 returns to the forward position. As again shown if FIGS. 8 and 9, the displacement of the plunger 32 is not enough to cause the inwardly extending end 46 to disengage from the notch 48 in the bolt carrier assembly 34, 34*a*. The side charging handle of this invention can be used with a standard-length bolt carrier assembly 34*a*, which extends beyond the rear of the upper receiver 14 when retracted, or with a shortened bolt carrier assembly 34 that reciprocates entirely within the upper receiver 14.

Referring now in particular to FIGS. 4 and 10-12, according to another aspect or embodiment of the present invention, a shortened-length bolt carrier assembly 34 is provided. In many respects, the bolt and bolt carrier body 54 are dimensioned and function like that of a standard AR-pattern bolt carrier, shown at 34*a*. Different is that the bolt carrier body 54 does not need to extend rearwardly the full length of the upper receiver 14 (when in battery) in order to contact a standard buffer and recoil spring (not shown) that would be housed in a receiver extension (not shown) of the lower receiver 12. Instead, as will be described in greater detail below, a recoil spring 56 is housed within the upper receiver 14, including in an area where a standard rear charging handle (not shown) would ordinarily be situated. The shortened bolt carrier assembly 34 and recoil spring 56 may be adapted for either a direct impingement or gas piston system, as will be readily understood by a person of ordinary skill in firearms design.

The bolt carrier body 54 includes a gas key portion 58 that may be integrally formed with the bolt carrier body 54. An engagement tube 60 may extend forwardly from the gas key portion 58 and connect with either a gas tube 62 (shown in FIG. 12) or an operating rod (not shown) of a gas piston system. In a direct impingement system, the engagement tube 60 and gas key portion 58 would direct propellant gasses into the bolt carrier body 54 to act on the bolt 64 in the well-known way. In a gas piston operating system, the engagement tube 60 could be either eliminated or used to guide an operating rod that would bear against the key portion 58 to drive the bolt carrier assembly 34 rearward to cycle the action.

Figure 10:
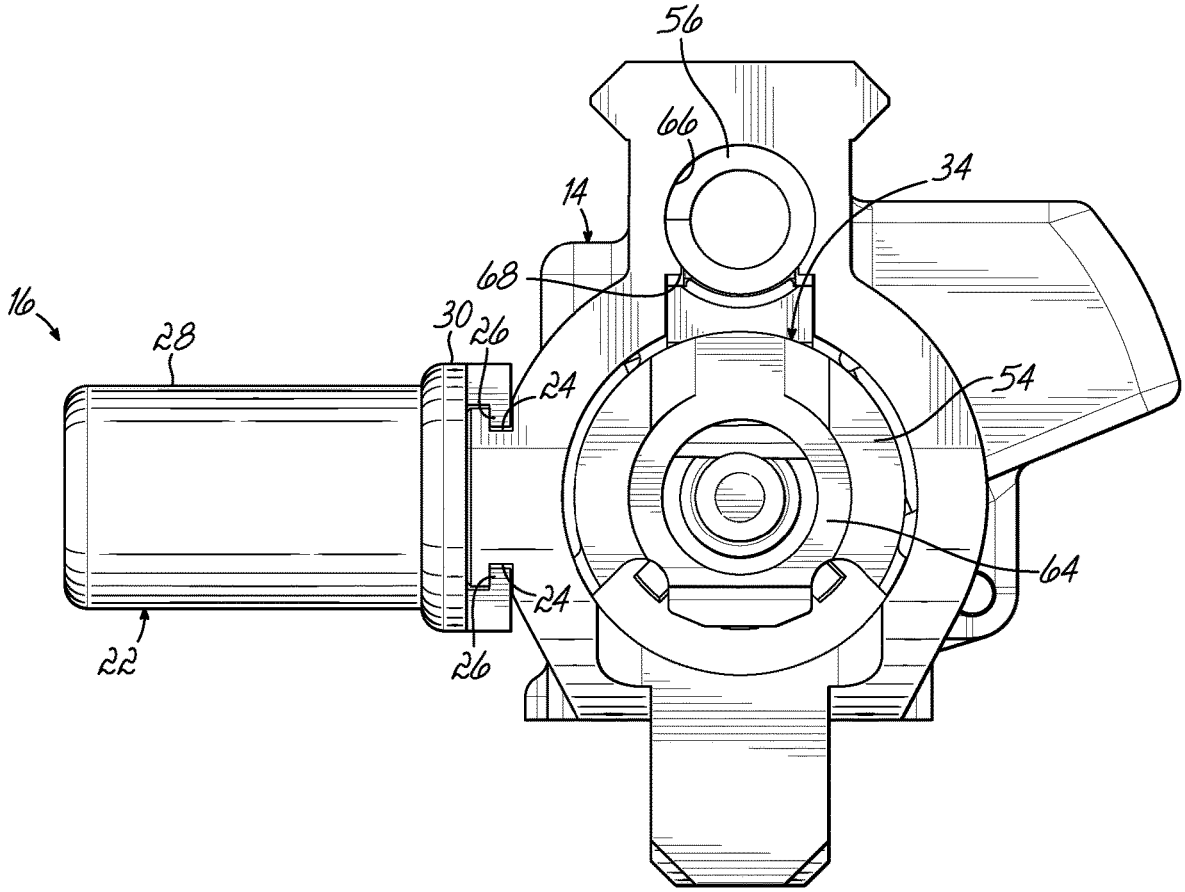
FIG. 10 is a rear elevation view of an upper receiver, bolt carrier assembly, and side charging handle assembly according to embodiments of the present invention.
Figure 11:
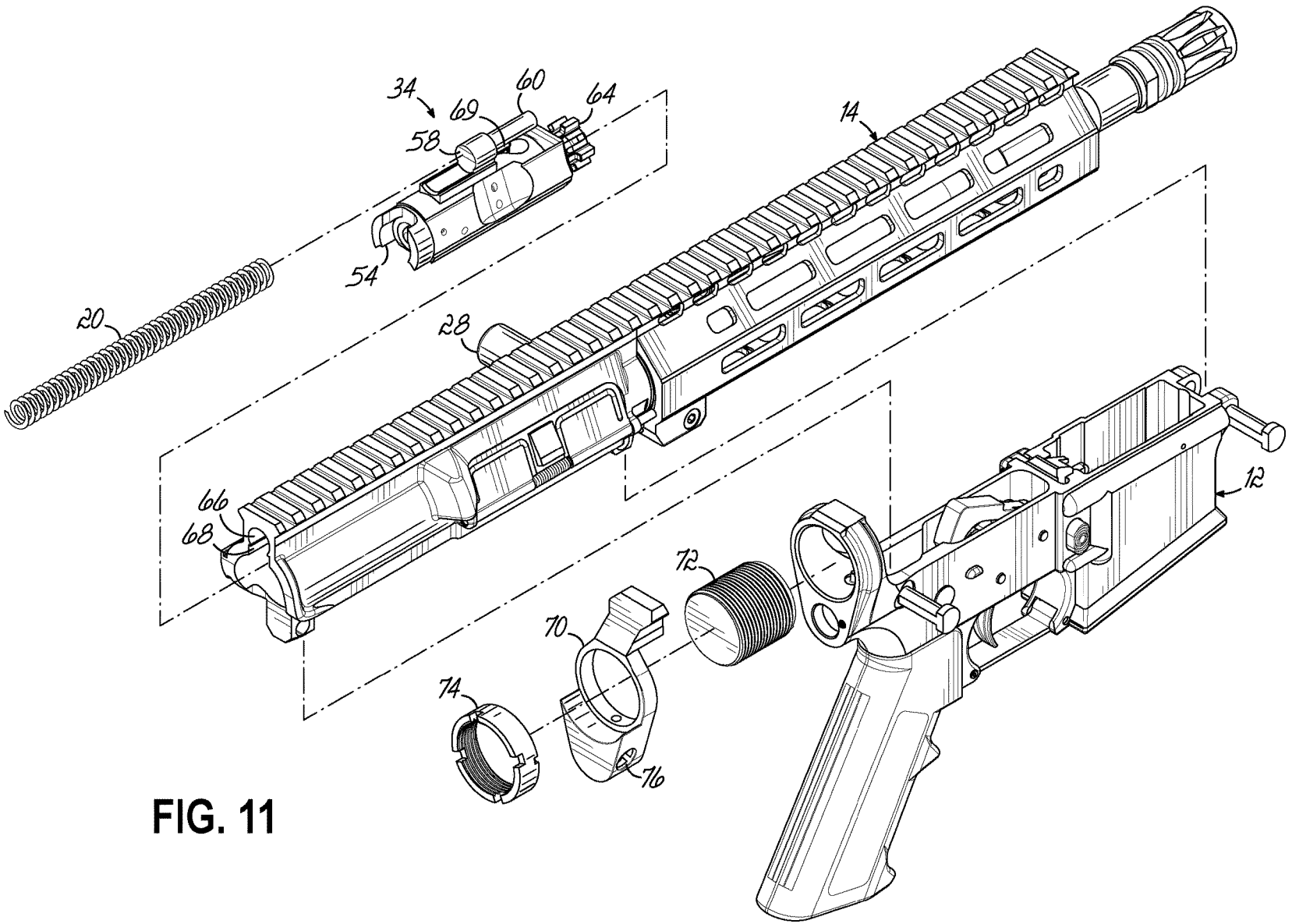
FIG. 11 is an exploded isometric view showing an upper receiver assembly, bolt carrier assembly, recoil spring, and lower receiver assembly according to embodiments of the present invention.
Figure 12:
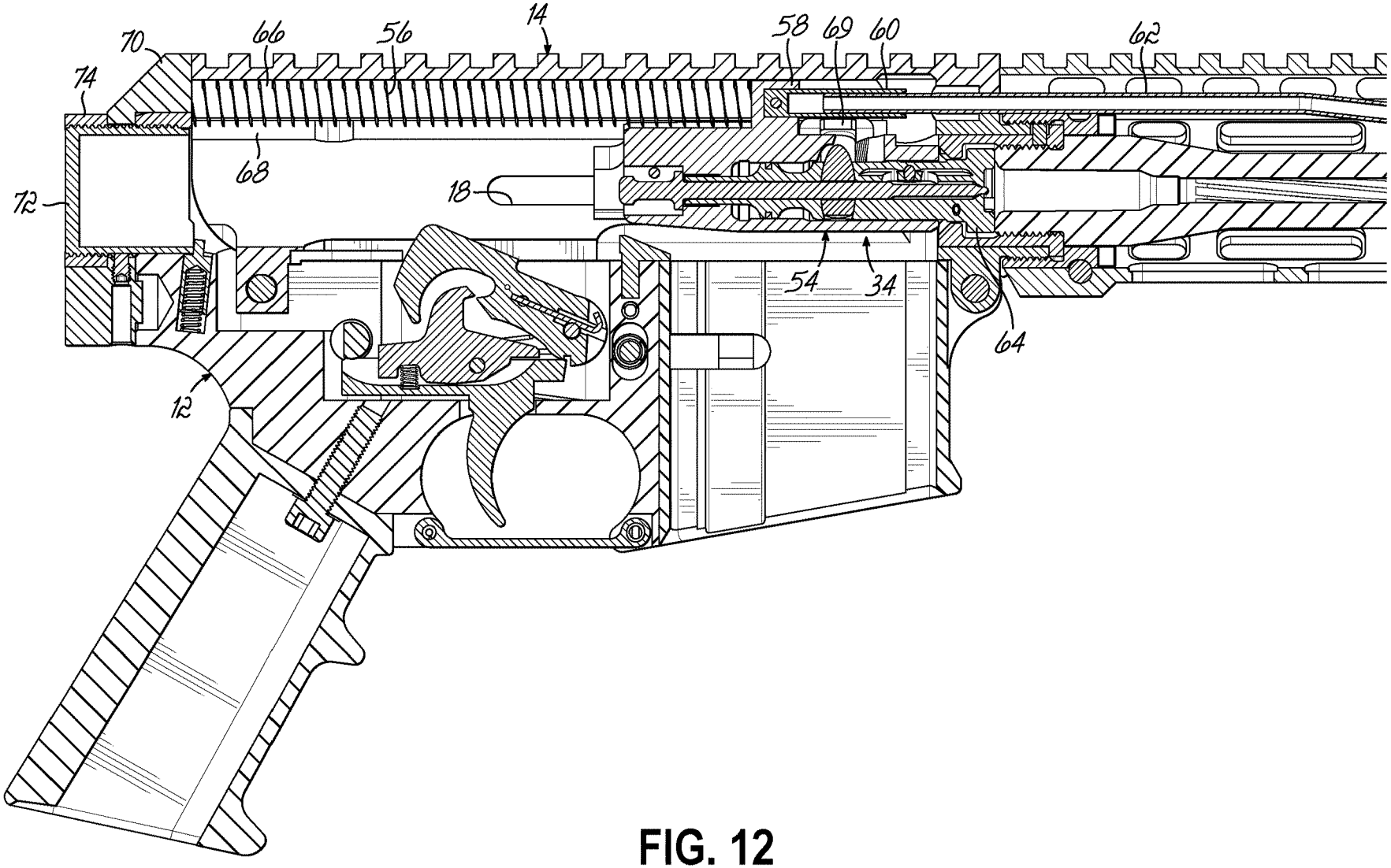
FIG. 12 is a longitudinal side sectional view of an upper and lower receiver assembly according to embodiments of the present invention.

The gas key portion 58 also acts as an abutment for the recoil spring 56, allowing the recoil spring 56 and gas tube 62 (or operating rod) to be positioned in substantial axial alignment with one another. As shown in FIGS. 10, 11, and 12, the recoil spring can be housed in a guide channel 66 in an upper portion of the upper receiver 14. The guide channel 66 supports more than half, but less than all, of the circumference of the recoils spring 56, providing a bottom guide opening 68 along its length. The guide opening 68 engages a lower part of the gas key portion 58 and guides the recoil spring 56 as it is compressed and extended without the need for a guide rod. The cam pin 69 can be guided by the guide opening 68 as the bolt carrier assembly 34 reciprocates rearwardly. The recoil spring 56 occupies a space that might otherwise be used for a rear charging handle (not shown) that has been replaced by the previously described side charging handle 16.

A rear abutment for the recoil spring 56 may be provided by an end plate 70 that may be attached to the lower receiver 12 with an end tube 72 and castle nut 74, as shown in FIGS. 11 and 12. In this manner, the recoil spring 56 is housed completely within, and the bolt carrier 34 reciprocates completely within, the upper receiver 14. In the illustrated embodiment, the end plate 70 provides a single point sling attachment feature. 76. Alternatively, some other stop means (not shown) for the rear end of the recoil spring 56 may be provided in or on the upper receiver 14.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A side charging handle system for an auto-loading firearm, comprising:

an upper receiver configured to attach to a lower receiver and having an internal longitudinal bore receiving a bolt carrier assembly for longitudinal reciprocation therein, a side longitudinal guide slot, and;

a side charging handle having an engagement pin extending through guide slot to engage the bolt carrier assembly; and the bolt carrier assembly including a bolt carrier body with an engagement pin socket configured to cause rearward movement of the bolt carrier assembly when the charging handle is retracted to the rear in the side longitudinal guide slot while allowing the bolt carrier assembly to retract independently of the side charging handle, wherein the side longitudinal slot includes a detent recess adjacent a forward end and the engagement pin is spring biased relative to the charging handle into releasable engagement with the detent recess such that the charging handle remains in the forward position in engagement with the detent recess when the bolt carrier cycles automatically, unless manually displaced from the detent recess.

2. The charging handle system of claim 1, further comprising a first guide track on the upper receiver substantially parallel to the longitudinal guide slot and the charging handle including a sliding cover having a second guide track that engages first guide track for sliding movement thereon and that substantially covers the longitudinal guide slot when the charging handle is in a forward position.

3. The charging handle system of claim 1, wherein the engagement pin socket is a recess open in a forward direction.

* * * * *